United States Patent [19]

Sakurai

[11] Patent Number: 4,568,275

[45] Date of Patent: Feb. 4, 1986

[54] FIXING DEVICE AND FIXING ROTARY MEMBER THEREFOR

[75] Inventor: Masaaki Sakurai, Hannoh, Japan

[73] Assignee: Canon Kabushiki Kaisha, Tokyo, Japan

[21] Appl. No.: 443,527

[22] Filed: Nov. 22, 1982

[30] Foreign Application Priority Data

| | | | |
|---|---|---|---|
| Nov. 25, 1981 | [JP] | Japan | 56-188911 |
| Nov. 25, 1981 | [JP] | Japan | 56-188912 |
| Nov. 25, 1981 | [JP] | Japan | 56-188913 |
| Nov. 25, 1981 | [JP] | Japan | 56-188914 |

[51] Int. Cl.[4] ..... F27B 9/28; B21B 31/08; H05B 1/00

[52] U.S. Cl. ..... 432/60; 29/130; 219/216

[58] Field of Search ..... 432/60; 219/216; 29/130

[56] References Cited

U.S. PATENT DOCUMENTS 4,257,699 3/1981 Lentz ..... 219/216

FOREIGN PATENT DOCUMENTS 0002864 1/1983 Japan ..... 432/60
8005770 1/1983 Japan ..... 432/60

*Primary Examiner*—John J. Camby
*Attorney, Agent, or Firm*—Fitzpatrick, Cella, Harper & Scinto

[57] ABSTRACT

A fixing device includes a first rotary member and a second rotary member for pinching and transporting a bearing member for fixing a toner image formed thereon. The first and second rotary members are pressed to each other. At least the first rotary member is provided with a surfacial layer containing a mixture of fluorinated rubber and fluorinated resin powder.

38 Claims, 7 Drawing Figures

FIXING DEVICE AND FIXING ROTARY MEMBER THEREFOR

BACKGROUND OF THE INVENTION

1. Field of the Invention

The present invention relates to a fixing device for forming a toner image in an image forming apparatus for such as an electrophotographic apparatus or an electrostatic recording apparatus, and more particularly to such fixing device provided with a rotary member such as a roller or a belt.

2. Description of the Prior Art

The toner offsetting in a fixing device with a roller has conventionally been prevented by providing the fixing roller with a releasing surface layer composed for example of RTV silicone rubber or Teflon (trade name of du Pont de Nemeur) and eventually by coating a releasing agent such as silicone oil. A fixing roller surfacially covered with RTV silicone rubber permits simplification of the device as the coating of the releasing agent is generally unnecessary and provides satisfactory fixing ability owing to the elasticity of silicone rubber, but is inevitably associated with a very short service life, requiring frequent replacements because of rapid time-dependent deterioration of the releasing ability. On the other hand the releasing agent such as silicone oil, if applied for maintaining the releasing ability, swells the silicone rubber and deteriorates the mechanical strength thereof, thus leading again to frequent replacements of the roller.

In comparison with the silicone rubber coated fixing roller described above, a fixing roller surfacially coated with a fluorinated resin such as tetrafluoroethylene-fluoroalkoxyethylene copolymer (hereinafter called resin A), polytetrafluoroethylene resin (hereinafter called resin B) or Teflon (trade name of du Pont de Nemeur) has a higher strength and shows sufficient releasing ability if silicone oil is applied thereon.

Such roller is however associated with the disadvantages of lower fixing ability in comparison with the aforementioned silicone rubber coated roller and of crushing the image in fixing a toner image on a toner image bearing member thereby deteriorating the image quality, because of the lack of elasticity. Furthermore, in case a mechanical member such as a cleaning blade is maintained in contact with the roller, the roller may be easily damaged due to the lack of elasticity when a hard dust particle sticking on the roller intrudes between said member and the roller.

The above-mentioned improved fixing ability attained with an elastic member such as silicone rubber is presumably ascribable to a fact that the fixing roller can adapt itself to the profile of the toner image on the image bearing member, thus achieving uniform contact over the entire surface.

On the other hand it is estimated that a rigid roller composed for example of Teflon contacts strongly with the protruding area of the toner image and the bearing member but gives only an unstable contact with the recessed area thereof, thus resulting in a very insufficient image fixation in such recessed area. Experimental results show that a same toner image can be completely fixed at a lower temperature by 20° to 50° C. with silicone rubber rather than with Teflon.

Japanese Patent Laid-Open No. Sho 48-85151 discloses a fixing roller composed of a mixture of powder of tetrafluoroethylene resin and unvulcanized silicone rubber, but such roller is associated with the drawbacks of a very low mechanical strength because of poor compatibility, mutual dispersibility and adhesion between the silicone and the resin, and a significant loss of mechanical strength resulting from swelling of the silicone rubber when a releasing agent such as silicone oil is applied on the roller.

SUMMARY OF THE INVENTION

An object of the present invention is to provide a fixing device equipped with a novel rotary fixing member not associated with the aforementioned drawbacks and capable of exhibiting an excellent fixing effect.

Another object of the present invention is to provide a fixing device capable of showing satisfactory releasing ability, fixing ability and mechanical strength over a prolonged period.

Still another object of the present invention is to provide a fixing device adapted for use as a thermal fixing device of a high thermal efficiency allowing reduced energy consumption, as well as achieving the foregoing objects.

Still another object of the present invention is to provide a fixing device capable of fully utilizing the physical properties of the material used for the fixing rotary member while retaining the elasticity and the releasing ability required for image fixation.

Still other objects and details of the present invention will become fully apparent from the following description.

DETAILED DESCRIPTION OF THE PREFERRED EMBODIMENTS

According to the present invention, a rotary member such as a fixing roller or a fixing belt is given a surfacial layer comprising a mixture of a rubber material and resin powder belonging to a same family in order to achieve various effects to be explained later, particularly superior fixing ability and releasing ability to those conventionally achieved. It will be understood from the following description that particularly preferable results can be achieved by a rotary member provided with a surfacial layer comprising a mixture of fluorinated rubber and fluorinated resin powder.

Figure 1:
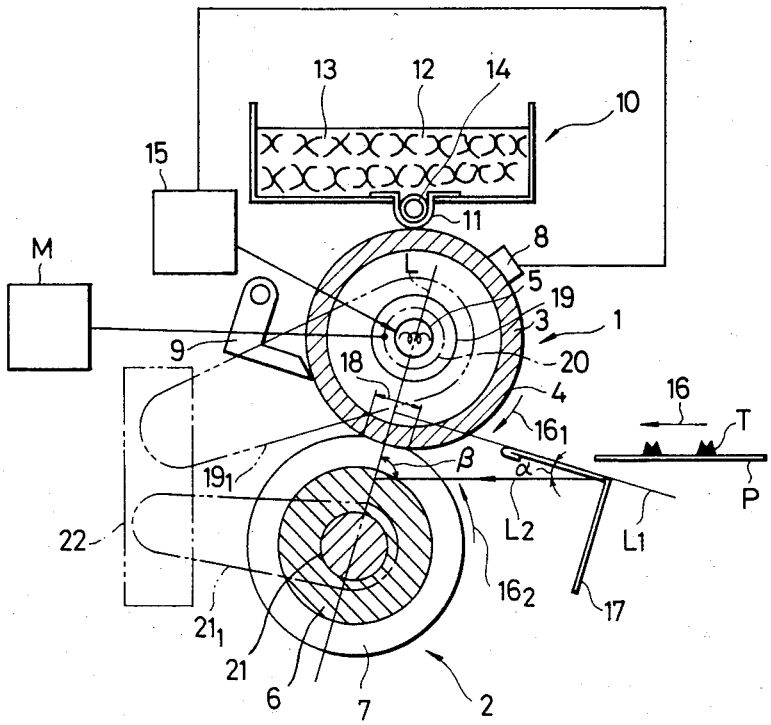
FIG. 1 is a schematic view of an embodiment of the present invention partially sectioned along the transport direction of a bearing member.

Referring to FIG. 1, a heating roller 1, rotated in a direction indicated by an arrow $\mathbf{16}_1$ by conventionally known driving means M, is maintained in rotary contact with a pressure roller 2 rotating in a direction of arrow.

Said heating roller 1 is composed of a hollow cylindrical metal core 3 and a surfacial layer 4 of a thickness of 100μ provided on the external periphery thereof and composed of a mixture of fluorinated rubber and a fluorinated resin, and is internally provided with a heater 5 such as a halogen heater. Said heating roller 1 is prepared by coating the hollow cylindrical core 3 with an aqueous dispersion of 100 parts by weight of fluorinated rubber, fluorinated resin and a mixing agent, further containing 7 parts by weight of a hardening agent, into a thickness of 100μ and treating said core at 350° C. for 30 minutes.

Said pressure roller 2 is maintained in pressure contact with the heating roller 1 by known pressurizing means at least during the image fixation, and is composed of a metal roller core 6 externally covered with a relatively thick silicone rubber layer 7, in order to secure a pressure contact area 18 with the heating roller 1.

On the periphery of the heating roller 1 there is provided a temperature detecting element 8 such as a thermistor or a thermocouple, from which a detection signal is supplied to known control means 15 whereby the external periphery of the heating roller 1 is controlled, by the output of or voltage to the heater 5, at a toner fusing temperature.

A gear 20 mounted on an unrepresented shaft of the heating roller 1 is driven by the driving means M to rotate the roller 1. A support member 19, rotatably supporting the shaft of said roller 1 is fixed on a pressure plate $\mathbf{19}_1$ provided at an end of the roller. A support member 21, rotatably supporting an unrepresented shaft of the pressure roller 2, is fixed on a pressure plate $\mathbf{21}_1$ provided at an end of the roller. Said pressure plates $\mathbf{19}_1$, $\mathbf{21}_1$ are provided with a known pressurizing mechanism 22 for pressing said plates, thus mutually pressing the heating roller 1 and the pressure roller 2.

An applicator 10 for applying an offset preventing liquid to the heating roller 1, coats a small amount of offset preventing liquid such as silicone oil on the surface of the heating roller through a fine porous film 11 maintained in contact with said roller. A spilling preventive member 13 composed of polyurethane foam prevents the spilling of the offset preventing liquid caused by vibration at the transportation of the apparatus. A tube 14 for maintaining the form of said porous film 11 and the contact state thereof to the heating roller 1 assures uniform contact of said porous film 11 with the heating roller, and is provided with fine continuous pores same as those in the porous film 11.

Said film 11 and tube 14 are composed of a porous film of tetrafluoroethylene (pore volume ratio 76% and 85% respectively; pore size 0.1–1.5μ both in the film and tube) manufactured by Sumitomo Denko Co., Ltd. under a trade name of Floropore. The offset preventing liquid is composed of dimethylsilicone oil having a viscosity of 10,000 cs at room temperature, manufactured by Shinetsu Chemical Co., Ltd. under a trade name of KF-96H. A line L connecting the centers of said rollers form an angle $\beta$ (>0) to the advancing direction L2 of the paper P, while a guide member 17 positioned in front of said rollers for guiding the paper P toward the heating roller 1 forms an angle $\alpha$ to said direction L2. In the present embodiment said angles $\alpha$, $\beta$ are so selected as to satisfy a condition $90° > \beta > \alpha > 0°$.

A paper sheet P bearing an unfixed toner image T is inserted between the rollers 1, 2 from a direction indicated by an arrow 16, and is ejected from the apparatus after said toner image T is fixed by the pressure and heat of said rollers. In order to securely separate the paper P from the heating roller, there are provided several separating claws 9 along the axial direction of the roller and in contact with the surfacial layer 4.

The above-described fixing device with the heating roller 1 of a diameter of 60 mmϕ and with a sheet advancing speed of 400 mm/sec provided satisfactory image fixation with sufficient image quality for a toner image formed on a paper sheet of 80 g/m$^2$ under conditions of a pressure contact area of 11 mm and a temperature of 140° C.

Also no trouble was found in continuous copying of 200,000 copies per minute at a speed of 34 copies in A3 size minute paper, with oil application of 2.5 grs./10,000 copies in A3 size. Also as a simulation of intrusion of dusts (clay contained in paper, magnetic particles in one-component developer, carrier particles in two-component developer etc.) iron particles of 50μ in diameter were put between the rollers but did not generate any damages.

As a reference example, a rigid roller having internal heating means and surfacially coated with PFA or PTFE (polytetrafluoroethylene) in a thickness of 80μ required a temperature of 165° C., which is significantly higher than 140° C. in the present embodiment, for satisfactory image fixation under comparable conditions. This difference is presumably ascribable to the aforementioned difference between the elastic member and the rigid member, and represents the specific effect of the present embodiment.

Also the PFA or PTFE coated heating roller mentioned above was damaged in streaks by the above-mentioned iron particles and generated defective image fixation at the locations of said streaks. It is presumed that an elastic roller having suitable rigidity and elasticity as in the present embodiment is capable of absorbing and dispersing local pressure while a rigid roller, for example the PFA or PTFE coated heating roller, is easily damaged by local stresses such as the friction caused by metal powder.

Following table compares the scratch resistances of the roller of the present embodiment and of the above-mentioned conventional roller. The comparison was made by measuring the depth of a scratch, formed on the roller by a ball point pen under a load of 0.15 kg, with a surface coarseness tester (Universal surface profile tester SE-3C manufactured by Kosaka Kenkyusho). The thickness of surfacial layer was 80μ in all measurements.

TABLE 1

| | Temp. | Roller of present embodiment | PFA-coated roller | PTFE-coated roller |
|---|---|---|---|---|
| Depth (μ) of scratch formed by ball point pen | 20° C. | <1 μ | 1.5–2.0 | 1.0–1.5 |
| | 150 | 1.5–2.0 | 3.5–4.0 | 3.0–3.5 |
| | 200 | 1.5–2.0 | 5.5–6.0 | 4.5–5.0 |

As shown in the foregoing table, the roller of the present embodiment showed relatively stable behavior except for a certain change according to the surface temperature, while the PFA or PTFE coated rigid rollers showed significant change in behavior according to the temperature, generating scratches 1.5 times to 3 times deeper than in the present embodiment.

In this manner the heating roller of the present embodiment has a far superior service life and a far superior resistance against foreign matters such as metal patricles.

In continuation to the foregoing description of the advantage of the present embodiment over a conventional rigid roller, there will now be given an explanation on the advantage over a conventional elastic roller, i.e. so-called rubber roller.

As a reference example, a roller composed of a hollow metal roller, as in the present embodiment, coated with HTV silicone rubber of a JIS hardness of 50° in a thickness of 0.5 mm, showed satisfactory image fixation at 140° C. in the same manner as in the present embodiment. In the presence of iron particles, the scratches on the reference roller were similar in depth to those in the present embodiment but were more easily formed due to the softer surface. With respect to the service life, the reference heating roller generated irregular profile in the diameter partly due to the applied oil giving rise to creases in the copies and often showed toner offsetting after 50,000 copies. After 70,000 to 80,000 copies, the reference roller became finally unusable because of peeling between the silicone rubber and the hollow metal core roller. Also a roller composed of a hollow metal roller coated with fluorinated rubber of a JIS hardness of 70° in a thickness of 0.5 mm proved impractical because of toner offsetting and frequent paper jamming after about 10,000 copies, and the service life could only be extended to about 20,000 copies even with an increase in the amount of offset preventing liquid. In this manner the long service life with satisfactory fixing ability as achieved in the present embodiment cannot be attained by the conventional rubber rollers.

As explained in the foregoing, the heating roller of the present invention allows realization of a fixing device capable of ensuring satisfactory fixing ability with saving of energy and maintaining a stable performance over a prolonged period.

In the following there will be explained further preferred examples of the foregoing embodiment.

In the foregoing embodiment the coating thickness of the surfacial layer and the temperature of thermal treatment were varied, and the heating roller of superior service life or durability to the prior art could be obtained within a range of coating thickness from 60 to 500$\mu$ and within a range of thermal treating temperature from 250° to 400° C. Particularly a thickness exceeding 60$\mu$ in said range did not generate streaking scratches even in the presence of iron particles, and showed a further improved service life with satisfactory fixing ability.

On the other hand a coating exceeding 500$\mu$ in thickness had an unnegligible thermal insulating effect, leading to an imprecise temperature control. Consequently the coating thickness should preferably not exceed 500$\mu$.

A roller treated under 250° C. showed significant toner offsetting after 10,000 copies, presumably because the surface becomes rich in the fluorinated rubber component at a low treating temperature, whereby the property of said fluorinated rubber becomes predominent and deteriorates the releasing property. On the other hand it is proved that the surface becomes rich in the fluorinated resin component at a high treating temperature, thus improving the releasing property. However the desired performance of the heating roller cannot be obtained in excess of 400° C., which is the limit of the thermal resistance of the fluorinated rubber and fluorinated resin. Consequently the fixing or pressure roller should preferably be treated at a temperature within a range from 250° to 400° C.

In the above-described embodiment the present invention is applied to the thermal fixing roller, but the foregoing description is applicable also to the pressure roller 2 maintained in pressure contact with the heating roller 1, to both rollers, to a pressure fixing roller, or further to other rotary members such as a conveyor belt employed in the fixing device. In the following there will be briefly explained a few embodiments of such applications in relation to FIGS. 2 and 3.

Figure 2:
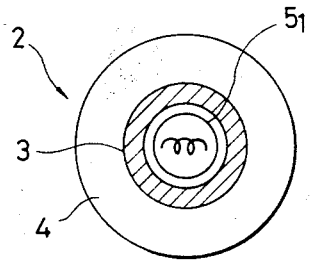
FIG. 2 is a cross-sectional view of a roller constituting another embodiment of the present invention.

FIG. 2 schematically shows a pressure roller 2 embodying the present invention. In general, the pressure roller 2 seldom touches the unfixed image, and may have a relatively low surface temperature in the order of 80° to 100° C. at minimum. For this reason a heat source for the pressure roller is often omitted, and the essential properties required therefor are suitable elasticity and suitable heat insulation and durability of the surface. In consideration of these requirements, the pressure roller of the present embodiment is composed of a hollow metal roller 3, provided therein with a relative weak heat source $\mathbf{5}_1$ and covered with a surfacial layer 4 thicker than in the heating roller 1 and composed of a fluorinated resin and fluorinated rubber. The thickness of said surfacial layer 4 may be in the order of 0.5 mm as in the aforementioned rubber coated elastic roller or larger than in the heating roller 1, and the temperature at roller formation may exceed the range of 250° to 400° C. and may particularly exceed 400° C. in order to improve the releasing ability.

Figure 3:
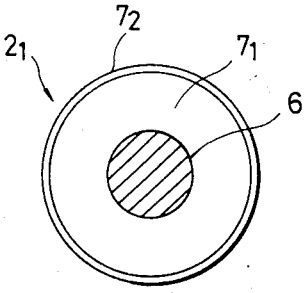
FIG. 3 is a cross-sectional view of a pressure roller adapted for use in the present invention.

FIG. 3 shows a pressure roller $\mathbf{2}_1$ not provided with the heat source for application in a pressure fixing device or as a pressure roller in a heat fixing device. Said roller $\mathbf{2}_1$ is composed of a metal roller core 6 covered with a relative thick elastic rubber layer $\mathbf{7}_1$, around which fitted is a polytetrafluoroethylene tube. Said roller $\mathbf{2}_1$ is particularly adapted for use as the pressure roller maintained in contact with the heating roller 1 shown in FIG. 1.

Also a pressure fixing device with excellent fixing ability and durability can be composed of the above-mentioned heating roller 1 not provided with the heat source as a pressure roller coming in contact with the toner image and of the above-mentioned pressure roller $\mathbf{2}_1$ maintained in pressure contact with said heating roller. Said pressure roller $\mathbf{2}_1$ may be replaced by a metal roller.

As explained in the foregoing, the present invention provides an excellent fixing device with a prolonged service life while maintaining a satisfactory fixing ability.

In the following there will be explained, again with reference to FIGS. 1, 2 and 3, another embodiment of the present invention, which is featured by the presence of a heat conductive material in addition to the rubber material and the resin powder of a same family and is particularly adapted for use in a heat fixing device.

In the following embodiment the aforementioned surfacial coating layer 4 will be replaced by a mixed surfacial layer 4 while other components are the same as explained before and are therefore not explained in detail.

A heating roller 1 is composed of a hollow metal roller core 3 surfacially covered with a mixed surfacial layer 4 in a thickness of 500μ composed essentially of fluorinated rubber, a fluorinated resin and heat conductive material, and provided internally with a heater 5 such as a halogen heater.

Said heating roller 1 is prepared by coating the roller core 3 with a mixture of an aqueous dispersion of 100 parts by weight of fluorinated rubber and fluorinated resin, 25 parts by weight in total of nickel oxide, cobalt oxide, zinc oxide and titanium oxide as the heat conductive material, and 6 parts by weight of a hardening agent into a thickness of 500μ, and by treating the obtained coating at 350° C. for 40 minutes.

Said pressure roller 2 is maintained in pressure contact with the heating roller 1 at least during the fixing operation by means of known pressurizing means. Said pressure roller 2 is composed of a metal roller core 6 covered with a relatively thick silicone rubber layer 7 for forming a contact area 18 with said heating roller.

The above-described fixing device with the heating roller 1 of a diameter of 60 mmϕ and with a sheet advancing speed of 400 mm/sec provided satisfactory image fixation with sufficient image quality for a toner image formed on a paper sheet of 80 g/m$^2$ under conditions of a pressure contact area of 11 mm and a temperature of 140° C.

Also no trouble was found in continuous copying of 200,000 copies at a speed of 34 copies per minute in A3 size paper, with oil application of 2.5 grs./10,000 copies in A3 size. Also iron particles of 50μ in diameter, introduced between the coated layer and the roller as a simulation of dust intrusion, did not cause any damage.

In the present embodiment various values were tested for the coating thickness of the surfacial layer and for the temperature of thermal treatment, and a preferable heating roller could be obtained within a thickness range of the mixed surfacial layer from 60 to 1500μ and within a temperature range of thermal treatment from 250° to 400° C. A coating less than 60μ thick generated streaking scratches in the presence of the iron particles, sometimes causing deficient image fixation at the location of said scratches. Also a coating exceeding 1500μ resulted in an imprecise temperature control because of unnegligible heat insulation effect and was therefore not suitable for the heat fixing roller, but showed improved heat efficiency and elasticity in comparison with the foregoing embodiment.

Within the above-mentioned ranges, it is found that a thickness of 80μ or larger is preferable in order to further improve the fixing ability. A surfacial layer of such thickness is considered to be capable of maintaining a sufficient temperature for heating with a stable temperature distribution, in addition to providing satisfactory durability, mechanical strength and stability in image quality. Also the pressure distribution for a toner image or a copy sheet with uneven profile becomes uniform, thus ensuring stabler image fixation.

The foregoing explanation on the temperature of thermal treatment is applicable also to the present embodiment.

The amount of the heat conductive material is preferably in a range from 10 to 35 parts by weight with respect to 100 parts by weight of fluorinated resin and fluorinated rubber in order to obtain particularly desirable effects such as satisfactory temperature control and stable fixing ability resulting therefrom. The heat conductive material present less than 10 parts by weight limits the heat conduction, so that it becomes difficult to increase the coating thickness beyond 500μ. Consequently the effect of elasticity, for reducing the scratch formation and stabilizing the image fixation, achievable at a large coating thickness, cannot be expected. Also an amount of the heat conductive material exceeding 35 parts by weight deteriorates the releasing ability, and thus necessitates the use of offset preventing means such as silicone oil for improving the releasing ability. Said heat conductive material is preferably composed of carbon black, metal oxides such as nickel oxide, titanium oxide or cobalt oxide, or such metal oxides having metal plating thereon such as nickel plating.

The following table compares the heating roller of the present invention having a mixed surfacial layer of 500μ in the aforementioned manner with similar rollers coated with the aforementioned resin A and B respectively.

TABLE 2

| | Temp. | Roller of present embodiment | Resin A coated roller | Resin B coated roller |
|---|---|---|---|---|
| Depth (μ) of scratch formed by ball point pen | 20° C. | <1 μ | 1.5–2.0 μ | 1.0–1.5 μ |
| | 150 | <1 μ | 3.5–4.0 | 3.0–3.5 |
| | 200 | <1 μ | 5.5–6.0 | 4.5–5.0 |

As shown in the foregoing table, the roller of the present embodiment showed relatively stable behavior except a certain change according to the surface temperature, while the resin A or B coated rigid roller showed significant change in behavior according to the temperature, forming scratches 1.5 times deeper and often more than 5 times deeper at normal fixing temperature range of 150° to 200° C.

In this manner the heating roller of the present embodiment has a far superior service life and a far superior resistance against foreign matters such as metal particles.

Also said heating roller is superior in the service life and in fixing ability and is capable of significantly reducing the crease formation on the copy sheets in comparison with a conventional elastic roller having a silicone rubber layer of a same thickness. Furthermore the heating roller of the present embodiment is thermally more stable and allows use of a weaker heat source, thus saving energy consumption, in comparison with the conventional rollers. In this manner the long service life with stable fixing ability achievable in the present embodiment is not at all achievable in the conventional rubber coated roller.

As explained in the foregoing, the heat fixing roller embodying the present invention allows provisions of a fixing device of a long service life capable of exhibiting satisfactory fixing ability with coupled energy saving and stable performance for a prolonged period.

In the above-described embodiment the present invention is applied to the heat fixing roller shown in FIG. 1, but the foregoing description is also applicable, as in the foregoing embodiment, to the pressure roller 2 maintained in pressure contact with the heating roller 1, to both rollers, to a pressure fixing roller or further to other rotary members such as a conveyor belt employed in the fixing device.

Now there will be explained another embodiment again with reference to FIG. 2. The foregoing explanation on FIG. 2 applies to this embodiment, except that the surfacial layer 4 is composed of a mixture of a fluorinated resin, fluorinated rubber and a metal oxide as the heat conductive material, and has a thickness larger than in the heating roller. The thickness of said surfacial layer 4 may be in the order of 0.5 mm as in the aforementioned rubber coated elastic roller or larger than in the heating roller 1, and the temperature at roller formation may exceed the range of 250° to 400° C. and may particularly exceed 400° C. in order to improve the releasing ability.

Also a pressure fixing device with excellent fixing ability and durability can be composed of the above-mentioned heating roller 1 not provided with the heat source as a pressure roller coming in contact with the toner image and of the above-mentioned pressure roller $2_1$ shown in FIG. 2 but not provided with the heat source $5_1$.

In the foregoing embodiment the presence of a heat conductive material provides stable heat balance necessary for heat fixing, and allows the use of a thicker coating layer providing improved elasticity.

In case the roller coated with the mixture of fluorinated rubber and fluorinated resin according to the first mentioned embodiment shown in FIG. 1 is used as a pressure roller or in a pressure fixing device, said thickness may be larger than 500μ.

Figure 4:
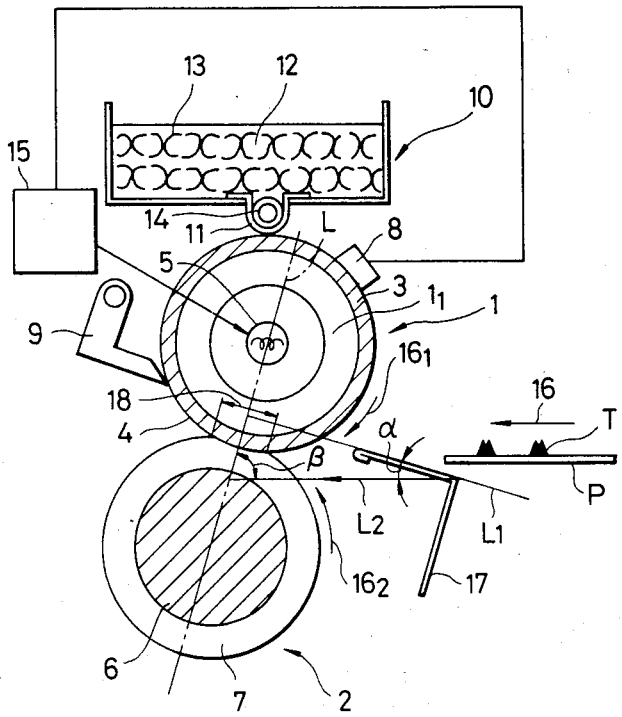
FIG. 4 is a view similar to FIG. 1, showing another embodiment of the present invention.
Figure 5:
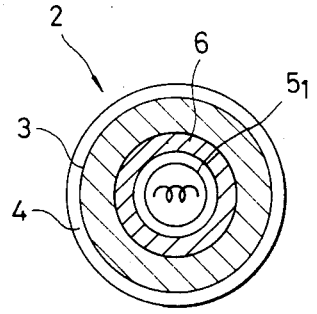
FIG. 5 a cross-sectional view of a roller constituting another embodiment of the present invention.
Figure 6:
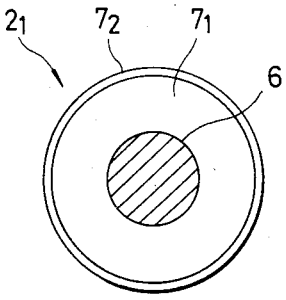
FIG. 6 is a cross-sectional view of a pressure roller adapted for use in the device shown in FIG. 4.

Now reference is made to FIGS. 4, 5 and 6 for explaining still other embodiments of the present invention. In the following explanation the components similar to those already shown in FIGS. 1, 2 and 3 will not be explained in detail. These embodiments are featured by the use of two-layered structure as will be explained later for improving the fixing ability as well as the elasticity and durability.

In FIG. 1, a heating roller 1 is rotated in a direction indicated by an arrow $16_1$, and a pressure roller 2 is maintained in rotary contact therewith in a direction indicated by an arrow $16_2$.

The heating roller 1 is composed of a hollow cylindrical metal roller core $1_1$externally covered by a fluorinated rubber layer 3 of 50μ in thickness and further by a mixed surfacial layer 4 of 25μ in thickness composed of a mixture of fluorinated rubber and a fluorinated resin, and internally provided with a heater 5 such as a halogen heater. Said surfacial layer 4 may be formed by any method adapted for forming a rubber layer of an arbitrary thickness, but in the present embodiment the heating roller 1 is formed by coating the roller core $1_1$ with liquid fluorinated rubber in thickness of 50μ, then vulcanizing said coating by heating at 150° C., preferably with a reduced time for obtaining a semi-vulcanized state, then further applying a mixture of an aqueous dispersion of 100 parts by weight of the fluorinated rubber, fluorinated resin and a mixing agent and of 7 parts by weight of a liquid hardening agent into a thickness of 25μ, and thereafter treating the entire roller at 350° C. for 30 minutes. The above-mentioned semi-vulcanized fluorinated rubber is completed vulcanized in this state and is firmly bonded to the core and to the surfacial layer.

Said pressure roller 2 is maintained in pressure contact with the heating roller 1 at least during the fixing operation by means of known pressurizing means. The structure of said roller 2 is same as that explained before.

The above-described fixing device with the heating roller 1 of a diameter of 60 mmϕ and with a sheet advancing speed of 400 mm/sec provided satisfactory image fixation with sufficient image quality for a toner image formed on a paper sheet of 80 g/m$^2$ under conditions of a pressure contact area of 11 mm and a temperature of 140° C.

Also no trouble was found in continuous copying of 200,000 copies at a speed of 34 copies in A3 size per minute, with oil application of 2.5 grs./10,000 copies in A3 size. Also iron particles or 50μ in diameter, introduced between the coated layer and the roller as a simulation of dust intrusion, did not cause any damage.

As already explained in the foregoing embodiment shown in FIG. 1, a surfacial layer 4 having a thickness in a range from 60 to 500μ and formed in a temperature range from 250° to 400° C. provides the heat fixing roller with preferable service life and fixing ability. It is also found that a thickness of 70μ or larger is preferable for stabilizing the fixing ability. A surfacial layer of such thickness is considered to be capable of maintaining a sufficient temperature for heating with a stable temperature distribution, in addition to providing satisfactory durability, mechanical strength and stability in image quality. Also the pressure distribution for a toner image or a copy sheet with uneven profile becomes uniform, thus ensuring stabler image fixation.

In the following there will be given an explanation on the examples and effects of the fluorinated rubber layer 3 provided inside the above-mentioned surfacial layer 4. In the present embodiment the strength of adhesion is very high because two layers of similar structures are superposed, so that the surfacial layer 4 can be of a thickness enough for attaining a desired surfacial strength. The elasticity can be sufficiently compensated by the underlying fluorinated rubber layer, which in addition allows reduction of the production cost and realization of a desired thickness. The cost reduction becomes particularly significant when the elastic layer is thick. A silicone layer used instead of the fluorinated rubber layer as a reference example showed poor adhesion to the above-mentioned surfacial layer 4 and was practically unacceptable because of fragility. On the other hand the present embodiment provides an appropriate strength and an excellent durability.

Also it is possible, as explained before, to further improve the strength and durability by applying the surfacial layer 4 on the rubber layer in the unvulcanized state and by simultaneously vulcanizing said rubber layer 3 and said surfacial layer 4.

As a reference example, a roller composed of an elastic or rigid roller surfacially covered with the aforementioned resin A or B and provided therein with heating means shows satisfactory image fixation only at 165° C., which is considerably higher than 140° C. in the present embodiment, under same conditions as explained before. This difference is considered to be ascribable, as explained in the foregoing, principally to the difference between the elastic material used in the present embodiment and the rigid material such as the resin A or B, and well exhibits the effect of the present embodiment. Also in the presence of iron particles as explained before, the heating roller coated with the resin A or B formed streaking scratches and showed defective image fixation at the location of said scratches. It is therefore presumed that an elastic material having rigidity as well as elasticity as employed in the present embodiment is capable of absorbing and dispersing a local stress but a rigid material such as the resin A or B is damaged since local stress such as the friction by the iron particles acts directly on said material.

Following table shows the comparison of scratch resistance of the heating roller of the present embodiment with that of the above-mentioned resin coated rollers.

TABLE 3

| | Temp. | Roller of present embodiment | Resin A coated roller | Resin B coated roller |
|---|---|---|---|---|
| Depth (μ) of scratch formed by ball point pen | 20° C. | <1 μ | 1.5–2.0 μ | 1.0–1.5 μ |
| | 150 | <1 μ | 3.5–4.0 | 3.0–3.5 |
| | 200 | <1 μ | 5.5–6.0 | 4.5–5.0 |

As shown in the foregoing table, the roller of the present embodiment showed relatively stable behavior except a certain change according to the surface temperature, while the resin A or B coated rigid roller showed significant change in behavior according to the temperature, forming scratches 1.5 times deeper or more and often more than 5 times at normal fixing temperature range of 150° to 200° C.

In this manner the heating roller of the present embodiment has a far superior service life and a far superior resistance against foreign matters such as metal particles.

Also with respect to elasticity, the roller of the present embodiment is far superior to the conventional rollers simply coated with silicone rubber or fluorinated rubber, but such superiority will be readily understandable from the foregoing description in relation to FIG. 1. In this manner the long service life combined with stable fixing ability achievable in the present embodiment is not at all expected in the conventional rubber coated rollers.

As explained in the foregoing, the heat fixing roller embodying the present invention allows provision of a fixing device of a long service life capable of exhibiting satisfactory fixing ability coupled with energy saving and stable performance for a prolonged period.

In the above-described embodiment the present invention is applied to the heat fixing roller, but it is also applicable to the pressure roller 2 maintained in pressure contact with the heating roller 1, to both rollers, to a pressure fixing roller or further to other rotary members such as a conveyor belt in the fixing device.

FIG. 5 shows another embodiment in which, as already shown in FIG. 2, the present invention is applied to a pressure roller. The essential requirements for the pressure roller are a suitable elasticity, a surfacial heat insulation and a durability of the surface. In consideration of the foregoing, the roller of the present embodiment is composed of a hollow metal roller core 6 internally provided with a relatively weak heat source $\mathbf{5}_1$ and externally covered with a fluorinated rubber layer 3 of a desired thickness and further with a surfacial layer 4 which is composed of a mixture of a fluorinated resin and fluorinated rubber and is thicker than in the heating roller 1. The thickness of said surfacial layer 4 may be in the order of 0.5 mm as in the aforementioned rubber coated elastic roller or larger than in the heating roller 1, and the temperature at roller formation may exceed the range of 250° to 400° C. and may particularly exceed 400° C. in order to improve the releasing ability.

FIG. 6 shows a pressure roller $\mathbf{2}_1$ which is not provided with the heat source and is adapted for use in a pressure fixing device or as a pressure roller in a heat fixing device. Said roller $\mathbf{2}_1$ is composed of a metal roller core 6 covered with a relatively thick elastic rubber layer $\mathbf{7}_1$ or a fluorinated rubber layer constituting a component of the present invention, on which there is fitted a polytetrafluoroethylene tube or provided a layer of a mixture composed of a fluorinated rubber and fluorinated resin according to the present invention. Said roller $\mathbf{2}_1$ exhibits an excellent effect as a roller to be maintained in pressure contact with the heating roller 1 shown in FIG. 4. Also a pressure fixing device of excellent fixing ability and service life can be composed of the above-mentioned heating roller 1, not provided with the heat source therein, as a pressure roller coming into contact with the toner image, and of the pressure roller $\mathbf{2}_1$ shown in FIG. 5 but not provided with the heat source $\mathbf{5}_1$. Said pressure roller $\mathbf{2}_1$ may be replaced by a metal roller.

In this manner the present invention enables realization of a fixing device with a prolonged service life with stable fixing ability.

Now reference is made again to FIGS. 4, 5 and 6 for explaining still another embodiment of the present invention, which is featured by the presence of a heat conductive material either in the aforementioned surfacial layer or in the rubber layer in order to further improve the heat efficiency, elasticity and strength in the foregoing embodiments. In the following description, components common with those already shown in the foregoing three embodiments will not be explained in detail or omitted.

In this embodiment, a heating roller 1 is composed of a hollow cylindrical metal roller core $\mathbf{1}_1$ internally provided with a heater 5 such as a halogen heater and externally covered with a fluorinated rubber layer 3 containing a heat conductive material and having a JIS hardness of 65° and a thickness of 450μ, and further covered with a mixed surfacial layer 4 of 60μ in thickness composed of a mixture of fluorinated rubber, a fluorinated resin and a heat conductive material. Said surfacial layer 4 may be formed by any method adapted for forming a rubber layer of an arbitrary thickness, but in the present embodiment the heating roller 1 is formed by coating the roller core $\mathbf{1}_1$ with liquid fluorinated rubber, in which the heat conductive material is dispersed, in a thickness of 450μ, then vulcanizing said coating by heating at 150° C., preferably with a reduced time for obtaining a semi-vulcanized state, then further applying a mixture of an aqueous dispersion of 100 parts by weight of fluorinated rubber, fluorinated resin and a mixing agent and of 5 parts by weight of a hardening agent in a thickness of 60μ, and thereafter treating the entire roller at 350° C. for 40 minutes. The above-mentioned semi-vulcanized fluorinated rubber is completely vulcanized in this state and is firmly bonded to the core and to the surfacial layer. Said heat conductive material can be of any substance capable of conducting heat as will be explained later.

Said pressure roller 2 is maintained in pressure contact with the heating roller 1 at least during the fixing operation by known pressurizing means.

The above-described fixing device with the heating roller 1 of a diameter of 60 mmϕ and with a sheet advancing speed of 400 mm/sec. provided satisfactory image fixation with sufficient image quality for a toner image formed on a paper sheet of 80 g/m$^2$ under conditions of a pressure contact area of 11 mm and a temperature of 140° C. Also no trouble was found in continuous copying of 200,000 copies at a speed of 34 copies per minute in A3 size paper, with oil application of 2.5 grs./10,000 copies in A3 size. Also iron particles of 50μ in diameter, introduced between the coated layer and the roller as a simulation of dust intrusion, did not cause any damage.

In relation to the foregoing, there will be given an explanation on a preferred range of formation of the surfacial layer 4 of the heating layer. The properties of said surfacial layer 4 vary according to the coating thickness and the treating temperature at the formation. In the present embodiment a heat fixing roller with improved durability and fixing ability can be obtained from the aforementioned reasons within a coating thickness range from 60 to 1500μ and a treating temperature range from 250° to 400° C.

Within the above-mentioned ranges, it is found that a thickness of 70μ or larger is preferable in order to further improve the fixing ability. A surfacial layer of such thickness is considered to be capable of maintaining a sufficient temperature for heating with a stable temperature distribution, in addition to providing satisfactory durability, mechanical strength and stability in image quality. Also the pressure distribution for a toner image or a copy with uneven profile becomes uniform, thus ensuring stabler image fixation.

In the following there will be given an explanation on the examples and effects of the fluorinated rubber layer 3 provided inside the above-mentioned surfacial layer 4. In the present embodiment the strength of adhesion is very high because two layers of similar compositions are superposed, so that the surfacial layer 4 can be of a thickness enough for attaining a desired surfacial strength. The elasticity can be sufficiently compensated by the underlying fluorinated rubber layer, which in addition allows reduction of the production cost and to obtain a desired thickness. The cost reduction becomes particularly significant when the elastic layer is thick. A silicone layer used instead of the fluorinated rubber layer as a reference example showed poor adhesion to the above-mentioned surfacial layer 4 and was practically unacceptable because of fragility. On the other hand the present embodiment provides an appropriate strength and an excellent durability. Said heat conductive material is preferably composed of carbon black, metal oxides such as nickel oxide, titanium oxide or cobalt oxide, or such metal oxides having metal plating thereon such as nickel plating.

The amount of the heat conductive material is preferably in a range from 5 to 35 parts by weight with respect to 100 parts by weight of fluorinated rubber or fluorinated rubber and fluorinated resin in order to obtain particularly desirable effects such as satisfactory temperature control and stable fixing ability combined therewith. The heat conductive material present in an amount less than 10 parts by weight limits the heat conduction, so that it becomes difficult to increase the coating thickness beyond 500μ. Consequently the effect of elasticity, for reducing the stratch formation and stabilizing and improving the image fixation, achievable at a large coating thickness, cannot be expected. Also an amount of the heat conductive material exceeding 35 parts by weight deteriorates the releasing ability, and thus necessitates the use of offset preventing means such as silicone oil for improving the releasing ability.

Furthermore a particularly preferable result with improved fixing ability can be obtained by adding carbon black in an amount of 5 to 100 parts by weight to the fluorinated rubber layer with respect to 100 parts by weight of said rubber and further adding a metal oxide such as nickel oxide, titanium oxide or cobalt oxide in an amount of 5 to 35 parts by weight to the surfacial layer 4 with respect to 100 parts by weight of the mixture of fluorinated rubber and fluorinated resin.

The roller of the present embodiment having a surfacial layer of 510μ, in comparison with rollers coated with the resin A or B in a thickness of 80μ, provided similar results to those shown in Tab. 3. These results indicate the excellent effect of the present embodiment, which also exhibits an excellent effect on elasticity similar to that achievable in the foregoing embodiments.

In the present embodiment, the present invention is applied to the heat fixing roller, but it is also applicable to the pressure roller 2 maintained in pressure contact with the heating roller 1, to both rollers, to a pressure fixing roller or even to other rotary members such as a conveyor belt in the fixing device.

Now reference is made to FIG. 5 again for explaining still another embodiment. As in the foregoing embodiments, the roller of the present embodiment is composed of a hollow metal roller core 3 internally provided with a heat source $5_1$ and externally covered with a fluorinated rubber layer 3 containing the above-mentioned heat conductive material, and further covered with a surfacial layer 4 having a larger thickness than in the heating roller 1 and composed of a mixture of fluorinated resin, fluorinated rubber and metal oxide as the heat conductive material. The thickness of said surfacial layer 4 may be of an arbitrary value, for example in the order of 0.5 mm as in the rubber-covered elastic roller or thicker than in the above-mentioned heating roller 1. Also the temperature at formation may exceed the range from 250° to 400° C. but may preferably exceed 400° C. in order to improve the releasing ability.

The foregoing explanation related to FIG. 6 is applicable also to the present embodiment.

In this manner the present invention contributes a fixing device of a prolonged durability combined with a stable fixing ability. The first and second layers according to the present invention are preferably provided over the entire length of the rotary member, but they may be provided on an entire part of the surface effective for image fixation or on a major part of the roller length.

Figure 7:
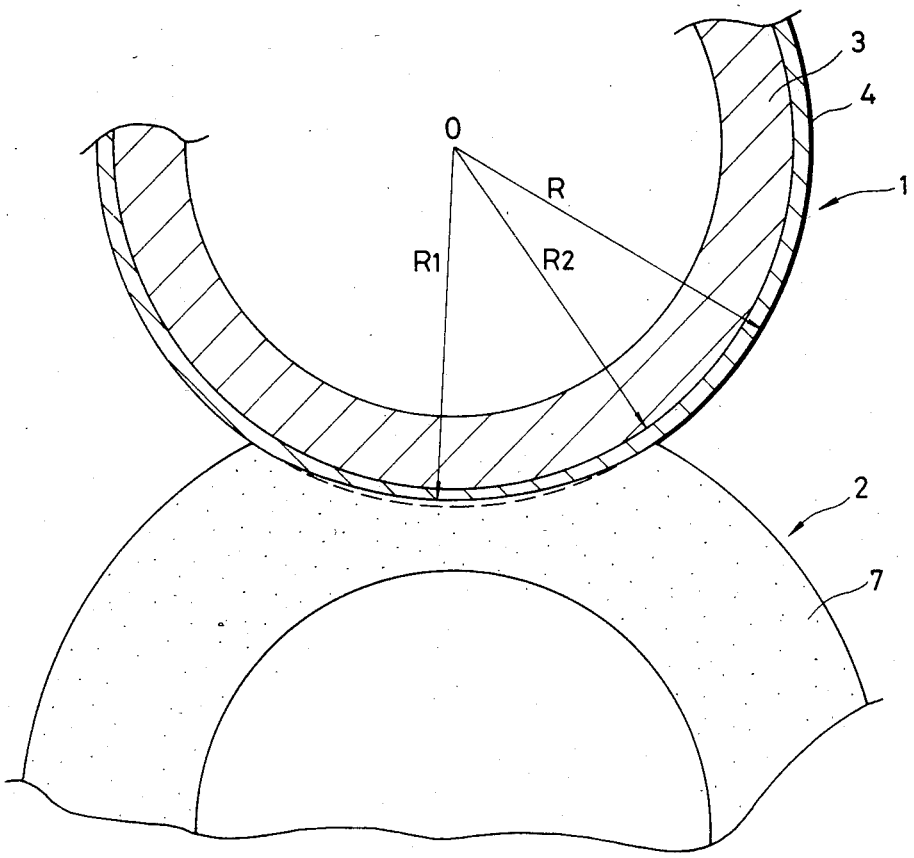
FIG. 7 is a schematic magnified view of an essential part showing the effect obtained according to the present invention.

FIG. 7 schematically shows the feature of the present invention, representing that an elastic member having rigidity and elasticity as in the present embodiment is capable of absorbing and dispersing a local stress applied thereon.

The surfacial layer 4 containing the fluorinated rubber and fluorinated resin powder shows excellent elasticity and releasing ability not achievable in the prior art. In case the pressure roller 2 is provided with an elastic rubber layer 7, there will presumably created a following phenomenon at the pressure contact area between the heating roller 1 and the pressure roller 2.

The external radius R1 and the internal radius R2 of the surfacial layer provide a margin for elastic deformation adapted to the profile of the toner image or the support member such as paper sheet at the image fixing operation in said pressure contact area. More specifically, in said pressure contact area, the external radius R1 of said surfacial layer has its center $O_1$ different from the center O of the roller and becomes larger than the original radius R of the roller because of said elastic deformation. In addition, the roller surface can deform according to the profile of the toner image in cooperation with the pressure roller. In this manner the toner image can be stably pressed without crushing effect. Also the heating is substantially uniform over the entire pressure contact area, thus improving the fixing ability.

Also the internal core composed of a metal provides rigidity and facilitates heating, while the rubber layer 3 enables a change in the internal radius of the surfacial layer, thus allowing sufficient change for the toner image even if it is extremely projecting.

The advantages of the present invention will be fully understood from the foregoing description.

I claim:

1. Fixing device comprising:

a first rotary member contacting with an unfixed image;

a second rotary member pinching and transporting together with said first rotary member a bearing member on which said unfixed image is to be fixed;

pressing means to apply pressure on said unfixed image between said first and second rotary members;

driving means for rotating said first and second rotary members;

said first rotary member having a surface layer formed by using a mixture of rubber material and a resin material having releasability superior to said rubber material, said surface layer being formed by heating and sintering the mixture so as to concentrate resin material at the outer portion of said surface layer to give surface releasability and elasticity.

2. Fixing device according to claim 1, wherein said resin material is fluorinated resin and said rubber material is fluorinated rubber and said surface layer is formed by heating-sintering at a temperature above 250° C. and the outer portion of said surface layer includes as majority component fluorinated resin of the mixture.

3. Fixing device according to claim 1, wherein said first rotary member has an elastic layer as an underlayer of said surface layer.

4. Fixing device according to claim 1, wherein said first rotary member has a heating member inside thereof, and said surface layer includes a heat conductive material.

5. Fixing device according to claim 3, wherein said rotary member has a heating member inside thereof, and said elastic layer includes a heat conductive material.

6. Fixing device according to claim 3, said elastic layer comprises rubber material of the same series of rubber material of the mixture of said surface layer.

7. Fixing device according to one of claims 3 to 6, wherein said surface layer is formed through a step of heating-sintering at a temperature above 250° C. said mixture dispersing resin material and rubber material in water or a solvent.

8. Fixing device comprising:

a first rotary member contacting with an unfixed image;

a second rotary member pinching and transporting together with said first rotary member a bearing member on which said unfixed image is to be fixed;

pressing means to apply pressure on said unfixed image between said first and second rotary members;

driving means for rotating said first and second rotary members;

said second rotary member having a surface layer formed by using a mixture of rubber material and resin material having releasability superior to said rubber material, said surface layer being formed by heating and sintering the mixture so as to concentrate resin material at the outer portion of said surface layer to give surface releasability and elasticity.

9. Fixing device according to claim 8, wherein said resin material is fluorinated resin and said rubber material is fluorinated rubber, and said surface layer is formed by heating-sintering the mixture at a temperature above 250° C. and the outer portion of said surface layer includes as majority component fluorinated resin of the mixture.

10. Fixing device according to claim 8, wherein said second rotary member has an elastic layer as an underlayer of said surface layer.

11. Fixing device according to claim 8, wherein said second rotary member has a heating member inside thereof, and said surface layer includes a heat conductive material.

12. Fixing device according to claim 10, wherein said elastic layer of said second rotary member is thicker than said surface layer.

13. Fixing device according to claim 10, wherein said elastic layer comprises rubber material of the same series of rubber material of the mixture of said surface layer.

14. Fixing device according to one of claims 10 to 13, wherein said surface layer is formed through a step of heating-sintering at a temperature above 250° C. said mixture having said resin material and rubber material in water or a solvent.

15. Fixing device comprising:

a first rotary member contacting with an unfixed image;

a second rotary member pinching and transporting together with said first rotary member a bearing member on which said unfixed image is to be fixed;

pressing means to apply pressure on said unfixed image between said first and second rotary members;

driving means for rotating said first and second rotary members;

said first rotary member having an elastic surface layer having a top releasability surface, and said second rotary member having a surface layer formed by using a mixture of rubber material and resin material having releasability superior to said rubber material, said surface layer being formed by heating and sintering the mixture so as to concentrate resin material at the outer portion of said surface layer to give surface releasability and elasticity.

16. Fixing device according to claim 15, wherein said resin material is fluorinated resin and said rubber material is fluorinated rubber and the surface layer is formed by heating and sintering at a temperature above 250° C. and the outer portion of said surface layer includes as majority component fluorinated resin of the mixture.

17. Fixing device according to claim 15, wherein the elastic surface layer of said first rotary member is formed by a mixture of rubber material and resin material having releasability superior to said rubber material, and said surface layer is formed by heating and sintering the mixture so as to concentrate resin material at the outer portion of said surface layer.

18. Fixing device according to claim 17, wherein said resin material is fluorinated resin and said rubber material is fluorinated rubber, the surface layers of said first and second rotary members, respectively, are formed by heating-sintering the mixture at a temperature above 250° C. and the top portion of said surface layer includes as majority component fluorinated resin of the mixture.

19. Fixing device according to one of claims 15 to 18, wherein said second rotary member has an elastic rubber layer underneath of said surface layer.

20. Fixing device according to claim 19, wherein said first rotary member has an elastic rubber layer underneath of an elastic surface layer and the rubber layer of said second rotary member is thicker than said elastic rubber layer of said first rotary member.

21. Fixing device according to claim 15 or 16, wherein the surface layer of said second rotary member includes heat conductive material in a predetermined amount from 10 to 35 parts by weight relative to 100 parts by weight of the mixture of resin material and rubber material.

22. Fixing device according to claim 17, wherein said first rotary member has heating means inside thereof, and said surface layer of said second rotary member includes heat conductive material in a predetermined amount from 10 to 35 parts in weight relative to 100 parts in weight of the mixture of resin material and rubber material.

23. Fixing device comprising:

a first rotary member contacting with an unfixed image;

a second rotary member pinching and transporting together with said first rotary member a bearing member on which said unfixed image is to be fixed;

pressing means to make said first and second rotary members pressing with each other;

driving means for rotating said first and second rotary members;

at least one of said first and second rotary members integrally having a surface layer formed by a mixture on an elastic rubber layer through a step of coating the mixture of rubber material and resin material having releasability superior to said rubber material on a semi-vulcanized base rubber surface of the rotary member and heating-sintering the whole of the rotary member so as to concentrate the resin material of said mixture at the outer portion of the surface of the rotary member.

24. Fixing device according to claim 23, wherein said mixture has fluorinated resin as a resin material and fluorinated rubber as a rubber material, the mixture is heated and sintered at a temperature above 250° C. but below 400° C. so as to make the resin material a majority component in the surface.

25. Fixing device according to claim 23, wherein said mixture contains heat conductive material in a predetermined amount of 10 to 35 parts in weight relative to 100 parts in weight of resin material and rubber material.

26. Fixing device according to claim 25, wherein the rotary member which has an elastic rubber layer and said surface layer on said elastic rubber layer is said second rotary member.

27. Fixing device according to claim 23, wherein the thickness of said elastic rubber layer is thicker than the surface layer.

28. Fixing device according to any one of claims 1, 3 to 6, 8, 10 to 13, 15, 17, 18, 23, 25 to 27, said resin material and said rubber material of the mixture are fluorocarbon resin and fluorocarbon rubber, respectively.

29. A rotary member for fixing, which contacts with an unfixed image comprises a surface layer formed by using a mixture of rubber material and a resin material having releasability superior to said rubber material, said surface layer being formed by heating and sintering the mixture so as to concentrate said resin material at the outer portion of the surface layer, the surface layer having a surface releasability and elasticity.

30. A rotary member for fixing according to claim 29, wherein said resin material is fluorinated resin and said rubber material is fluorinated rubber, and said surface layer is formed by heating and sintering the mixture at a temperature above 250° C., the outer portion of said layer has fluorinated resin of the mixture as a major component.

31. A rotary member for fixing according to claim 30 comprises an elastic rubber layer underneath of said surface layer.

32. A rotary member for fixing according to claim 30, wherein said surface layer comprises heat conductive material in a predetermined amount of 10 to 35 parts in weight relative to 100 parts in weight of the mixture of resin material and rubber material.

33. A rotary member for fixing according to claim 32, wherein the elastic rubber layer is thicker than said surface layer.

34. A rotary fixing member to be used for the back surface of a bearing member, on the front surface of which an unfixed image may be fixed, comprises a surface layer formed by using a mixture of rubber material and resin material having releasability superior to the rubber material, said surface layer being formed by heating and sintering the mixture so as to concentrate said resin material at the outer portion of the surface layer, the surface layer having a surface releasability and elasticity.

35. A rotary member for fixing according to claim 34, wherein said resin material is fluorinated rubber, and said surface layer is formed by heating and sintering the mixture at a temperature above 250° C., the outer portion of said surface layer has fluorinated resin of the mixture as a major component.

36. A rotary member for fixing according to claim 35 comprises an elastic rubber layer underneath of said surface layer.

37. A rotary member for fixing according to claim 36, wherein said surface layer comprises heat conductive material in a predetermined amount of 10 to 35 parts in weight relative to 100 parts in weight of the mixture of resin material and rubber material.

38. A rotary member according to claim 37, wherein said elastic rubber layer is thicker than said surface layer.

* * * * *

UNITED STATES PATENT AND TRADEMARK OFFICE

CERTIFICATE OF CORRECTION

PATENT NO. : 4,568,275

DATED : February 4, 1986

INVENTOR(S) : MASAAKI SAKURAI

It is certified that error appears in the above-identified patent and that said Letters Patent is hereby corrected as shown below:

Column 1, line 9, delete "for";
line 17, "de Nemeur)" should read --de Nemours)--;
lines 37-38, "de Nemeur)" should read --de Nemours)--;
line 53, "to a fact" should read --to the fact--.

Column 2, line 43, "FIG.5 a" should read --FIG. 5 is a--
line 46, "FIG. 4, and" should read --FIG. 4; and--;--

Column 4, line 14, delete "per minute" after "copies" and insert --per minute-- after "34 copies";
line 43, "Following table" should read --The following table--.

Column 5, line 4, "patricles" should read --particles.--

Column 6, line 40, "fitted is" should read --is fitted--.

Column 9, line 38, "$l_1$externally" should read --$l_1$ externally--.

Column 10, lines 4-5, delete "per minute" after "size" and insert --per minute-- after "34 copies".

UNITED STATES PATENT AND TRADEMARK OFFICE

CERTIFICATE OF CORRECTION

PATENT NO. : 4,568,275

DATED : February 4, 1986

INVENTOR(S) : MASAAKI SAKURAI

It is certified that error appears in the above-identified patent and that said Letters Patent is hereby corrected as shown below:

Column 11, line 1, "Following table" should read --The following table--.

Column 14, line 54, "presumably created" should read --presumably be created--.

Signed and Sealed this

Fourth Day of November, 1986

[SEAL]

*Attest:*

DONALD J. QUIGG

*Attesting Officer*

*Commissioner of Patents and Trademarks*